US007141147B2

(12) United States Patent
Shimamune

(10) Patent No.: US 7,141,147 B2
(45) Date of Patent: Nov. 28, 2006

(54) ELECTROLYTIC CELL

(75) Inventor: Takayuki Shimamune, Tokyo (JP)

(73) Assignee: Akzo Nobel N.V., Arnhem (NL)

( * ) Notice: Subject to any disclaimer, the term of this patent is extended or adjusted under 35 U.S.C. 154(b) by 268 days.

(21) Appl. No.: 10/167,403

(22) Filed: Jun. 13, 2002

(65) Prior Publication Data

US 2002/0189936 A1 Dec. 19, 2002

Related U.S. Application Data

(60) Provisional application No. 60/298,094, filed on Jun. 15, 2001.

(51) Int. Cl.
*C25B 9/04* (2006.01)
*C25B 1/46* (2006.01)

(52) U.S. Cl. ..... 204/252; 204/266; 204/297.14

(58) Field of Classification Search ..... 204/252–258, 204/263–266

See application file for complete search history.

(56) References Cited

U.S. PATENT DOCUMENTS 4,468,311 A * 8/1984 de Nora et al. ..... 204/252
4,502,935 A 3/1985 Lohrberg ..... 204/253
4,693,797 A 9/1987 deNora ..... 204/128
5,693,213 A * 12/1997 Shimamune et al. ..... 205/510
5,776,328 A 7/1998 Traini ..... 205/514
5,938,901 A 8/1999 Shimamune ..... 204/283
6,022,634 A * 2/2000 Ramunni et al. ..... 429/34
6,117,286 A * 9/2000 Shimamune et al. ..... 204/252
6,797,136 B1 * 9/2004 Shimamune ..... 204/252
6,841,047 B1 * 1/2005 Gestermann et al. ..... 204/252
2003/0047446 A1 * 3/2003 Gestermann et al. ..... 204/252
2003/0188966 A1 * 10/2003 Katayama ..... 204/297.14

FOREIGN PATENT DOCUMENTS

EP 0 410 159 A1 1/1991
EP 0 522 382 A1 1/1993

OTHER PUBLICATIONS

English language Abstract of EP 0 410 159.

* cited by examiner

*Primary Examiner*—Harry D Wilkins, III
(74) *Attorney, Agent, or Firm*—Wrb-IP LLP

(57) ABSTRACT

The invention relates to an electrolytic cell, and a method for manufacturing such cell. The cell comprises an anode and a cathode compartment, a separator partitioning the compartments, gas diffusion electrode members arranged to the separator with a space between adjacent electrode members in the vertical direction, and current collector members electrically connected to the electrode members. The current collector members comprise resilient means arranged to homogenise the contact between the electrode members, the current collector and the separator. The invention also relates to the use of the electrolytic cell for production of e.g. alkali metal hydroxide.

13 Claims, 2 Drawing Sheets

ELECTROLYTIC CELL

This application claims priority from U.S. Provisional Application No. 60/298,094, filed on Jun. 15, 2001, the subject matter of which is hereby incorporated by reference in its entirety.

The invention relates to an electrolytic cell suitable for producing alkali metal hydroxide and the use of such cell. The invention also relates to a method for manufacturing such cell.

BACKGROUND OF THE INVENTION

The electrolytic production of e.g. alkali metal hydroxides is today of considerable importance, although a large amount of energy is consumed in the electrolysis process. Many attempts have been made to lower the energy consumption, e.g. by use of a gas diffusion electrode in the electrolytic cell which is believed today to have the highest capability of saving electric energy and lower the production costs.

When the conventional electrolytic reaction (1) using a hydrogen-evolving metal electrode as cathode is replaced by a gas diffusion electrode, reaction (1) is replaced by reaction (2) as follows:

$$2NaCl+2H_2O \rightarrow Cl_2+2NaOH+H_2,\ E_0=2.21\ V \quad (1)$$

$$2NaCl+\tfrac{1}{2}O_2+H_2O \rightarrow Cl_2+2NaOH,\ E_0=0.96\ V \quad (2)$$

By converting a hydrogen-evolving metal electrode to a gas diffusion electrode, the cell voltage is reduced from 2.21 V to 0.96 V, thus an energy saving of about 60% becomes theoretically possible. Accordingly, various investigations have been conducted for performing chloralkali electrolysis using a gas diffusion electrode.

U.S. Pat. No. 5,938,901 discloses an electrolytic cell partitioned by an ion exchange membrane into an anode chamber and a cathode chamber. The electrolytic cell comprises current collectors electrically connected to horizontal electrode members having the shape of belts arranged with a space between the members in the vertical direction, which electrode members are contacted to the membrane.

However, it has been observed that the electrical contact between the belt-shaped electrode members and the current collectors is not satisfactorily homogeneous, which leads to inhomogeneous current distribution and higher cell voltage, as well as a shorter service life of the gas diffusion electrode. These problems arise especially if the horizontal and/or vertical dimensions of the electrode members are too long.

Furthermore, it has been noticed that partial drying, i.e. vacant portions, may occur in the cathode chamber between the membrane and the gas diffusion electrode due to formation of gaps caused by an insufficient amount of electrolyte filling such gaps. As a consequence of these problems, the cell voltage is often unstable and at a higher level, which shortens the life span of the gas diffusion electrode. The present invention intends to solve the problems mentioned above.

THE INVENTION

The present invention relates to an electrolytic cell comprising an anode and a cathode compartment, a separator partitioning the compartments, gas diffusion electrode members arranged to said separator with a space between electrode members in the vertical direction. The cell further comprises current collector members electrically connected to the electrode members. The current collector members comprise resilient means arranged to homogenise the contact between the electrode members, the current collector and the separator.

It has been surprisingly found that the present invention can maintain the operation of an electrolytic cell at a low and stable cell voltage due to the improved contact between the current collector, the gas diffusion electrode, and the separator. Moreover, it has been found that the invention solves the technical problem of unwanted drying, and flooding of electrolyte in the cathode compartment. The present invention also solves the technical problem of supplying oxygen-containing gas to the gas diffusion electrode in an effective way.

The electrode members are suitably shaped as belts, preferably as substantially squares. Suitably, the electrode members have a length of from about 2 to about 40 cm, preferably from about 10 to about 30 cm in the vertical direction in a conventional electrolytic cell of ordinary size. If the vertical length is less than about 2 cm, the preparation of the electrode members can be complicated. If the vertical length is longer than about 40 cm, the lower portion of the electrode member may be exposed to an excess of electrolyte, which will reduce the rate of the electrolytic reaction taking place at the gas diffusion electrode due to blockage of oxygen-containing gas supply caused by flooding of electrolyte.

Suitably, the electrode members have a length of from about 2 to about 40 cm, preferably from about 10 to about 30 cm, in the horizontal direction in a conventional electrolytic cell of ordinary size.

There is no particular restriction to the space between the electrode members in the vertical direction. The space may be appropriately selected in a range such that the reduction of electrolytic area is restrained and the release of electrolyte is smoothly carried out. It is highly advantageous that oxygen supplied to the cathode compartment is not hindered by remaining electrolyte on the electrode from diffusing into the gas diffusion electrode via the gas diffusion layer provided on the side facing away from the separator. The space between the electrode members in the vertical direction may be from about 1 to about 5 mm, preferably from about 2 to about 3 mm.

An electrolyte is allowed to flow downwards on the surface of each electrode member by gravity until it reaches the lower portion thereof. The space provided between the electrode members can to some extent prevent electrolyte from flowing down to the electrode member arranged underneath the foregoing electrode member. The electrolyte can partially flow along the space extending in the horizontal direction and further down to the bottom of the electrolytic cell.

To carry out the release of the electrolyte more smoothly, at least one electrolyte guide plate can be attached to an electrode member or between the electrode members in the vertical direction such that the guide plate is downwardly inclined to the opposite side of the separator. The electrolyte guide plate is preferably provided in the space between the vertically arranged electrode members. The electrolyte guide plate prevents electrolyte from flowing downwardly to the next-coming electrode members by guiding the electrolyte away from the electrode members underneath. The electrolyte guide plates suitably have a length from about 1 to about 3 mm, preferably from about 2 to about 3 mm.

There is no particular restriction as to the material used for the electrolyte guide plates as long as the material does not adversely influence the separator. Preferably, the electrolyte guide plates are prepared by moulding a corrosion resistant resin, such as a fluorine resin, polyethylene, polypropylene, or other suitable resins. The electrolyte guide plates may also be prepared by moulding a metal.

The electrode members themselves can also be downwardly inclined to the opposite side of the separator in the lower portion to prevent flooding of electrolyte. Preferably, each of the electrode members are downwardly inclined to the opposite side of the separator.

Preferably, a space is also provided between electrode members in the horizontal direction. Thereby, the electrode members do not necessarily continue over the whole horizontal direction in the cell, but may be divided into plural parts in the horizontal direction. In an embodiment where the electrode members are divided in the horizontal direction, electrolyte can flow down from each space formed by the horizontal division. Thus, electrolyte can easily be released from the electrode members. The structure of plural electrode members arranged both in the horizontal direction and the vertical direction with a space in between can be described as a patchwork.

Preferably, the space between the electrode members in the horizontal direction is from about 1 to about 5 mm, preferably from about 2 to about 3 mm.

The space between the electrode members cannot be employed for electrolysis. However, the space not employed is compensated by an increase in electrolytic efficiency, because the supply of the oxygen gas and discharge of the produced gases can be smoothly carried out and the electrolysis can be stably continued at a low voltage.

While electrolysis processes are carried out on a reaction layer of the gas diffusion electrode, electrolyte can permeate through the surface of the gas diffusion layer. If e.g. sodium hydroxide is being produced in the electrolytic cell, sodium ions and water from the anode compartment, which are supplied thereto as an aqueous sodium chloride solution, are transported via the separator to the reaction layer of the gas diffusion electrode. Oxygen-containing gas is led into the cathode compartment and supplied to the reaction layer via the gas diffusion layer so that it can react with water. Hydroxyl ions are thus formed, which subsequently react with sodium ions to form sodium hydroxide.

By the term "separator" is meant any separating means, such as an ion exchange membrane, a diaphragm or other separating means. Suitable membranes may be made of perfluorinated, sulphonated or teflon-based polymers, or ceramics. Also polystyrene-based membranes or diaphragm of polymers or ceramics may be used. There are several commercially available membranes suitable for use such as Nafion™ 324, Nafion™ 550 and Nafion™ 961 by Du Pont or Flemion™ by Asahi Glass.

The gas diffusion electrode members are electrically connected to current collector members, which supply electric current to the electrode members. The current collector members can be connected to the electrode members in various manners, e.g. by spot welding or wiring thereto. The current collector members and the gas diffusion electrode members may also be contacted frictionally without any further contacting means to ascertain electrical contact.

The current collector comprising plural current collector members is suitably made of a porous metal, e.g. expanded mesh, perforated or louvered plates so that gas and electrolytes thereby easily can be supplied and removed from the gas diffusion electrode members. The current collector members are suitably arranged to the wall opposite to the separator in the cathode compartment by resilient means, e.g. U or V-shaped springs or ribs, elastic louvers, or other elastic material. Suitably, the area of the current collector members contacted to the gas diffusion electrode members have the shape of a square or a rectangle adapted to the dimensions of the gas diffusion electrode members. Preferably, the current collector members have substantially the same dimensions as the gas diffusion electrode members so that they can be individually fitted thereto. The sides, i.e. the lengths or dimensions in the vertical and horizontal direction, of the current collector members connected to the gas diffusion electrode members are suitably not larger than 40 cm, because the homogeneous contact with the membrane can in those cases be insufficient, which can lead to inhomogeneous current distribution. In case the sides are shorter than 10 cm, the manufacturing of the current collector members may be very complicated. The sides of the current collector members are suitably from about 10 to about 40 cm, preferably from about 10 to about 30 cm, and most preferably from about 20 to about 25 cm.

The space between the current collector members is suitably from about 3 to about 10 mm, preferably from about 4 to about 6 mm. In case the space is too big, the cell voltage may be too high due to inhomogeneous current distribution in the cell. If the space is too small, the independent adjustments of the electrode members to the current collectors may be difficult.

According to a preferred embodiment of the invention, the electrolytic cell is a conventional cell comprising an existing hydrogen-evolving cathode, hereinafter called existing cathode, which has been retrofitted with gas diffusion electrode members.

The electrolytic cell can thus be a retrofitted cell further comprising a hydrogen evolving cathode electrically arranged between the gas diffusion electrode and the current collector members.

The gas diffusion electrode members can be arranged on the side of the existing cathode facing the separator. The existing cathode can then be used as current collector means to transfer current to the gas diffusion electrode. Slits in the horizontal direction are suitably made in the existing cathode to form plural cathode members, in such a way that the lower portion of the gas diffusion electrode members can be passed through the slits so that electrolyte can be eliminated from the gas diffusion electrode members. A space can thus be formed between the existing cathode members in the vertical direction. The distance between each slit suitably is from about 10 to about 40 cm, preferably from about 20 to 30 cm. The space between the vertical existing cathode members suitably is from about 3 to about 10 mm. Suitably, the gas diffusion electrode members are welded to the existing cathode members. On the opposite side of the existing cathode members, the current collector members are suitably arranged, suitably by means of welding so that a homogeneous contact can be secured. The shape of the existing cathode members suitably have about the same dimensions as the gas diffusion electrode members electrically arranged thereto.

Preferably, the gas diffusion electrode, comprising several electrode members, is a gas diffusion cathode. The gas diffusion electrode of the present invention is suitably obtained by sintering a silver powder on a surface of a gas-liquid permeable metal substrate such as a perforated plate, an expanded mesh, a metal foam, a sintered metal, a metal fibre structural material, or the like. The metal substrate can comprise silver alone, silver-plated copper or nickel or a mixture thereof. A thin layer comprising a carbon powder and a silver fibre having perforations in the thickness direction can then be formed on the surface of the metal substrate. The thin layer may be further subjected to fluorination treatment to fluorinate the carbon in the thin layer. Alternatively, a thin layer may be prepared by baking a paste obtained by kneading a silver powder and a fluorinated carbon compound such as a PTFE (polytetrafluoroethylene) resin at a temperature of from about 150° C. to about 350° C. In this case, the sintering method is optional and, for example, a silver powder having a particle size of from about 1 to about 10 μm is kneaded with a material such as dextrin, which functions as a binder and is evaporated off by sintering or burning. After coating the paste on the surface of the metal substrate followed by drying, the coated substrate can be sintered in air or in a weakly reducing atmosphere such as a hydrogen gas atmosphere at a temperature of from about 300° C. to about 600° C. The gas diffusion electrode thus prepared has sufficient catalytic activity as it is but an active catalyst such as platinum may be carried on the surface thereof. A butyl alcohol solution of chloroplatinic acid may be coated on the opposite side of the coated side of the substrate, followed by heat-treating of the coated metal substrate in a hydrogen gas atmosphere at a temperature of from about 150° C. to about 250° C. The surface of the gas diffusion layer is preferably hydrophilic, and sometimes removal of the electrolyte cannot be smoothly carried out as a result. Hence it is preferable that PTFE resin solution be coated on the surface of the gas diffusion layer and baked at a temperature of from about 150° C. to about 250° C. to impart a hydrophobic property to the gas diffusion layer.

According to a preferred embodiment, the gas diffusion electrode is prepared from a silver expanded mesh, which is suitably degreased and pickled in a mineral acid such as nitric acid. A silver paste, obtained from a silver powder of 0.5–2 μm particles mixed with e.g. glucose and water, can be applied to the expanded mesh. The silver paste-mesh is then suitably sintered at a temperature of about 450° C. in air. A di-nitro diamino platinum solution can then be applied on one side of the sintered silver mesh and baked at a temperature of 350° C. to form a platinum coating on the silver mesh. On the formed metallic platinum coating, a tetra butyl zirconate alcohol solution can be applied followed by baking at 450° C. in air atmosphere to form a zirconium dioxide coating upon the platinum coating. A 0.2 mm graphite cloth can then be applied on the zirconium dioxide layer to provide a path layer. The path layer keeps electrolyte in between the reaction layer of the gas diffusion electrode and the separator so as to drain the electrolyte properly which avoids flooding of the gas diffusion layer. The path layer can prevent the hydrophilic reaction layer of the gas diffusion electrode from becoming hydrophobic. On top of the graphite cloth, another layer of zirconium dioxide can be applied. On the opposite side of the platinum coating of the metal substrate, a PTFE solution can be applied and baked at 250° C. to provide a gas diffusion layer.

A path layer can also be separately arranged to the gas diffusion electrode, i.e. without being integrated in the gas diffusion electrode structure. It has been found that substantially no flooding occurs even though a relatively thin path layer is applied to the gas diffusion electrode. If the path layer is separately arranged to the gas diffusion electrode members, the path layer must be downwardly inclined opposite to the separator in the embodiments where the electrode members are so inclined. The path layer can be adhered on the reaction layer or adjacent to the reaction layer on the side facing towards the separator. The path layer may also be pressed between the gas diffusion electrode and the separator so no displacement thereof can occur. Preferably, the path layer is arranged to the separator with no or substantially no space in between. The typical material for the path layer is carbon, carbon cloth, carbon paper or the like, or mixtures thereof. Also $ZrO_2$, $SiO_2$, $TiO_2$, $HfO_2$ or other ceramic materials can be mixed with the carbon material to provide a path layer. Ceramic materials are especially suitable to provide a barrier between the path layer and the reaction layer in order to prevent chemical contact between carbon in the path layer and active catalytic particles present in the reaction layer which otherwise may be damaged due to chemical reactions with carbon, leading to formation of carbonates, which may render the hydrophilic reaction layer hydrophobic. Other gas diffusion electrode which may be used include such as mentioned in the European patent applications no.00850191.8 and no.00850219.7, and in U.S. Pat. No. 5,938,901.

The current density when the electrolytic cell is in operation is suitably from about 2 to about 6, preferably from about 3 to about 4 $kA/m^2$.

The invention also relates to a method for manufacturing an improved electrolytic cell as described herein. The method involves arranging a separator to partition an electrolytic cell into an anode and a cathode compartment. Gas diffusion electrode members are arranged to the separator with a space between electrode members in the vertical direction, and current collector members comprising resilient means are electrically connected to the electrode members.

The invention further relates to the use of an electrolytic cell as described herein. The electrolytic cell of the invention is preferably used for production of an alkali metal hydroxide such as KOH and/or NaOH, but may also be used for production of e.g. $Na_2SO_4$, HCl.

DESCRIPTION OF THE EMBODIMENTS

Figure 1:
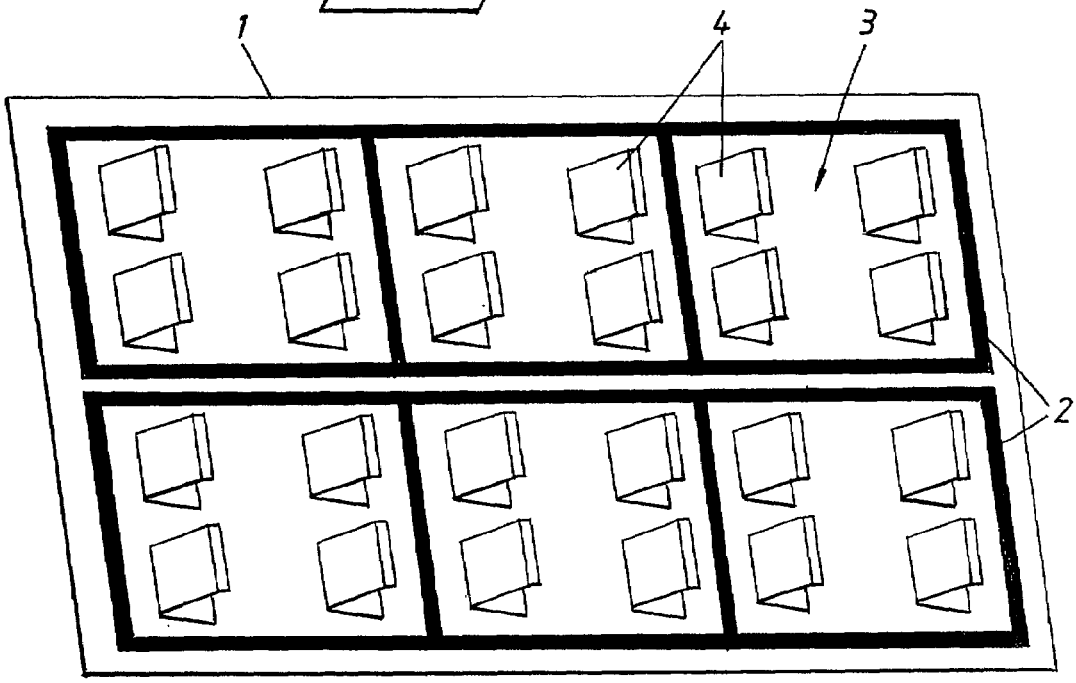
FIG. 1 shows a front view of a cell arrangement, in which gas diffusion electrode members have the shape of belts.

Referring to the drawings, FIG. 1 shows a gas diffusion electrode (2) attached to an ion exchange membrane (1). The gas diffusion electrode comprises belt-shaped members (2) on which a plural number of current collector members (3) are arranged. To the current collector members, resilient means (4) are arranged to secure a homogeneous current distribution over the whole electrode area.

Figure 2:
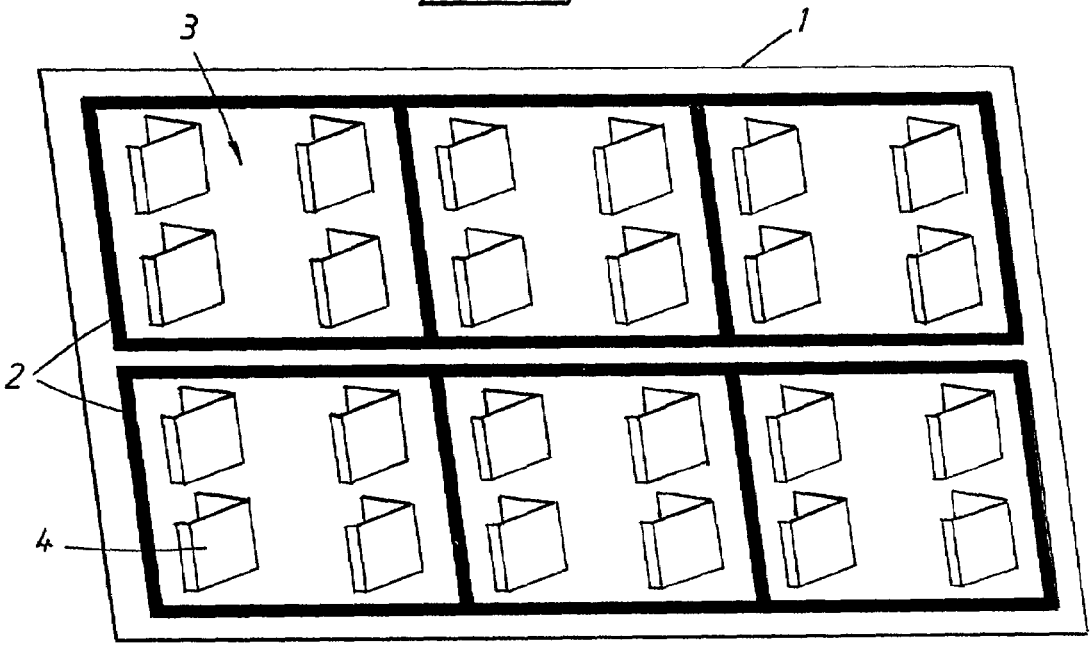
FIG. 2 shows a front view of a cell arrangement, in which gas diffusion electrode members have a patchwork structure.
Figure 3:
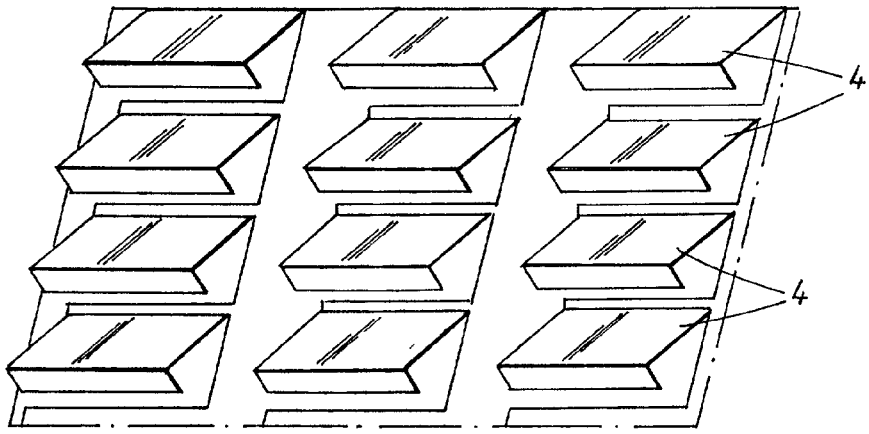
FIGS. 3–6 show various resilient means arranged to a current collector.
Figure 4:
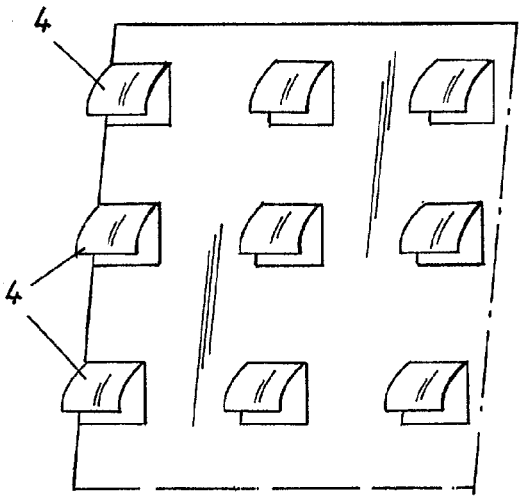
Figure 5:
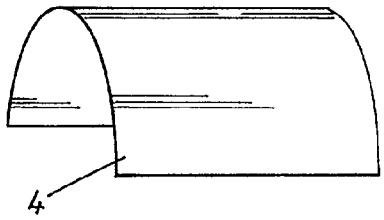

FIG. 2 shows a gas diffusion electrode (2) attached to an ion exchange membrane (1). The gas diffusion electrode comprises a plural number of electrode members (2) in arranged in the form of a patchwork attached to an ion exchange membrane (1) in the same way as in FIG. 1.

Figure 6:
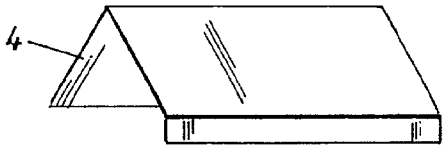

FIGS. 3–6 show various resilient means (4) which can be arranged to the current collector members. Such resilient means can be e.g. elastic louvers (FIGS. 3 and 4), substantially U-shaped ribs (FIG. 5), and substantially V-shaped ribs (FIG. 6).

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. The following examples will further illustrate how the described invention may be performed without limiting the scope of it.

EXAMPLE 1

A two compartment electrolytic cell, partitioned by a nafion™ 961 cation exchange membrane available from DuPont was used for the production of sodium hydroxide. The cell had a width of 40 cm, and a height of 120 cm. The anode compartment was made of titanium, in which a DSA™ (dimension stable anode) with expanded mesh substrate was welded to a flange and ribs in the anode compartment. In the cathode compartment, made of nickel, four rows of horizontally arranged ribs with v-shaped cross-section, imparting elastic properties to the current collectors, were welded to the bottom of the compartment. The elastic ribs were bent so they formed angles of about 45°. The upper portion of the ribs were arranged at the same height at a flange. The ribs were cut every 20 mm to be independently movable. 12 pieces of current collectors made of a nickel flattened expanded mesh plated with silver, each having the dimensions 195 mm×195 mm, were spread and welded to the ribs at the opposite side of the bottom, with the same space between the current collector members.

A gas diffusion electrode comprised four layers joined to each other in the following order: path layer of $ZrO_2$-graphite, a barrier layer of $ZrO_2$, a reaction layer of platinum coated silver, and a hydrophobic PTFE-silver layer being a gas diffusion layer.

The gas diffusion electrode was cut to the dimensions 195 (width)×210 (height) mm to form separate electrode members. 15 mm from the lower edge, the electrode members were downwardly inclined to the direction opposite to the cation exchange membrane. The electrode members were arranged to the current collector by spot welding.

After attachment of the electrode members to the cathode collector members, the electrolytic cell was fabricated by providing gas inlets and outlets, distributors, and continuous draining means for the electrolyte.

The electrolysis was performed by supplying 180 g/liter of NaCl to the anode compartment and water-containing oxygen gas to the cathode compartment. The operating temperature was 90° C. and the current density 4 kA/$m^2$.

The electrolysis could be performed without flooding at a stable cell voltage of 2.1 V, while obtaining a 32 wt % NaOH solution.

EXAMPLE 2

The electrolytic cell of example 1 was prepared in the same way, but with non-elastic ribs. When the cell was in operation, the cell voltage was unstable at a level about 2.4V. When the electrolysis process had been interrupted, the cell was opened for control. At the gas diffusion layer, electrolyte was observed due to insufficient and inhomogeneous contact between the membrane and the gas diffusion electrode. The area between the electrode members and the cation exchange membrane contained no electrolyte, and a portion of the electrode surface was dry. As a consequence, the electrolysis process suffered from a high local current density at some points because of inhomogeneous contact, and a high cell voltage.

EXAMPLE 3

The electrolytic cell of example 1 was prepared except that only one current collector was attached to one single electrode member. Electrolysis was performed under the same conditions as in example 1 except that the current density was 2 kA/$m^2$. The cell voltage obtained was 2.6 V. Flooding at the bottom of the cell occurred and a partial blinding area due to insufficient contact between the electrode and the ion exchange membrane was observed after having disassembled the cell. The flooding and the inhomogeneous contact also caused an elevated cell voltage.

The invention claimed is:

1. An electrolytic cell comprising an anode and a cathode compartment, a separator partitioning said anode and cathode compartments, gas diffusion electrode members arranged to said separator with a space between said gas diffusion electrode members in the vertical direction, current collector members electrically connected to said gas diffusion electrode members, wherein the current collector members comprise resilient means arranged to homogenize the contact between the gas diffusion electrode members, the current collector members and the separator.

2. An electrolytic cell as claimed in claim 1, wherein the gas diffusion electrode members have lower portions to which at least one guide plate is arranged.

3. An electrolytic cell as claimed in claim 1, wherein each of the gas diffusion electrode members has a lower portion which is downwardly inclined to the opposite side of the separator.

4. An electrolytic cell as claimed in claim 1, wherein the separator is an ion exchange membrane.

5. An electrolytic cell as claimed in claim 1, wherein the gas diffusion electrode members form a cathode.

6. An electrolytic cell as claimed in claim 1, wherein a space is provided between the gas diffusion electrode members in the horizontal direction.

7. An electrolytic cell as claimed in claim 1, wherein a space ranging from about 1 to about 5 mm is provided between the gas diffusion electrode members in the horizontal direction.

8. An electrolytic cell as claimed in claim 1, wherein the resilient means are elastic louvers.

9. An electrolytic cell as claimed in claim 1, wherein the resilient means are springs.

10. An electrolytic cell as claimed in claim 1, wherein a space ranging from about 1 to about 5 mm is provided in the vertical direction between the gas diffusion electrode members.

11. An electrolytic cell as claimed in claim 1, wherein the current collector members have horizontal and vertical dimensions from about 10 to about 40 cm.

12. An electrolytic cell as claimed in claim 1, wherein the electrolytic cell is a retrofitted cell comprising a hydrogen evolving cathode arranged between the gas diffusion electrode members and the current collector members.

13. A method for manufacturing an improved electrolytic cell comprising arranging current collector members comprising resilient means in electrical contact with gas diffusion electrode members with a space between the gas diffusion electrode members in the vertical direction, said gas diffusion electrode members being arranged to a separator in a conventional electrolytic cell further comprising anode and cathode compartments partitioned by said separator.

* * * * *